United States Patent [19]

Hollweck

[11] Patent Number: 4,839,626

[45] Date of Patent: Jun. 13, 1989

[54] POWER CONTROL DEVICE

[75] Inventor: Walter Hollweck, Heroldsberg, Fed. Rep. of Germany

[73] Assignee: Thermostat-und Schattgeratebau GmbH Co. KG, Bad Kissingen, Fed. Rep. of Germany

[21] Appl. No.: 175,521

[22] Filed: Mar. 31, 1988

[30] Foreign Application Priority Data

Apr. 1, 1987 [DE] Fed. Rep. of Germany ..... 3710387

[51] Int. Cl.[4] ..... H01H 37/14; H01H 37/52

[52] U.S. Cl. ..... 337/377; 337/107; 337/324

[58] Field of Search ..... 337/102, 103, 104, 105, 337/106, 107, 324, 377; 219/504, 505, 538, 552

[56] References Cited

U.S. PATENT DOCUMENTS 3,919,679 11/1975 Kingma ..... 337/377

*Primary Examiner*—H. Broome

*Attorney, Agent, or Firm*—Robin, Blecker & Daley

[57] ABSTRACT

A power control device of the type including a bimetallic element electrically heated in the course of supplying power to a heatable device, a switch having spring contacts activatable by swing movement of the bimetallic element and a regulator for adjusting the switching point of the switch is provided with a heating element at the swing end of the bimetallic element and provision is made for application of power to the heating element independently of the supply of power to the heatable device. Parallel circuits exist, one supplying power to the heatable device and the other to the heating element.

18 Claims, 3 Drawing Sheets

POWER CONTROL DEVICE

DESCRIPTION

Figure 1:
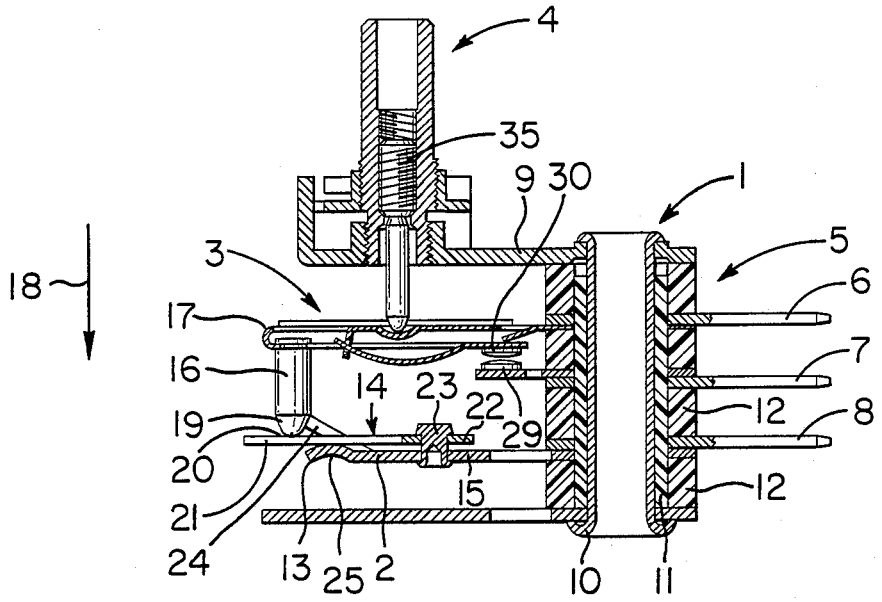

The invention concerns a power control device for electrically heated devices, particularly cooking devices. Cooking devices are understood to mean any devices which have a power consumer which produces heat for cooking, frying or baking, whose average energy output is controlled with a cycling power control module. It particularly concerns such devices as stove burners, ovens, grills, microwave ovens, kettles, hotplates and similar items.

A power control device of this type is known, for example, from P No. 32 19 517; this device essentially has a bimetallic element which can be electrically heated, a switch with spring contacts which can be activated by the swing movement of the bimetallic element, a regulator which can be activated manually, to influence the switching point of the switch with spring contacts, an extended carrier, to which the bimetallic element, the switch with spring contacts, contact elements, as well as a holder arm for the regulator are attached, essentially parallel to one another and essentially at a right angle of projection, a transfer pin arranged essentially parallel to the carrier, between the swing end of the bimetallic element and the activation end of the switch with spring contacts, with initial tension, spacers of insulating material between the parts which project away from the attachment element, as well as a large number of connection elements.

In this known power control device, the bimetal is heated directly by the work power which flows through the power consumer circuit, which is passed through the bimetal. For this purpose, the bimetal is formed in the shape of a long U-shaped element, with the swing end of the bimetal forming the U-turn and the root of the bimetal, which is attached at the attachment element, being divided. The one side of the root of the bimetal is connected with the power consumer, the other side has an electrical connection with a fixed contact which acts together with the movement contact of the switch with spring contacts, with the fixed contact in turn being arranged on the attachment element. The work power flows through the bimetal itself, because the power consumer and the bimetal are switched in series, which has the disadvantageous result that the cycling and therefore also the control behavior of the device are inseparably connected with the electrical characteristics of the power consumer. This means that the known regulator can only be used to regulate a very specific power consumer, adapted to the cycling behavior of the regulator, which also disadvantageously leads to a necessary equalization of the cycling behavior as a function of the power consumer which follows it, and furthermore results in increased inventory and possibly complications in case of repairs, since the power control device cannot be universally used for all types of power consumers.

The invention is based on the task of improving a power control device with the features of the preamble of claim 1 with simple means, in such a way that it can be used for extremely varied power consumers, that its cycling is no longer dependent on the electrical characteristics of the power consumer and that therefore it will be possible to obtain optional temperature control of several power consumers in one device, for example, with one and the same power control device. This task is solved by the characterizing features of claim 1, advantageous further developments of the invention are evident from the subsequent secondary claims.

The combination of features in claim 1 advantageously achieves the purpose that electrical heating elements with different structures and output can be operated using one and the same power control device. The cycling which occurs is completely independent of the type and the output of the power consumer which is connected, since the work and heating power circuits are conducted parallel to one another in the area of the power control device. Furthermore, due to the arrangement and the formation of the separately connected and structured heating element, well defined cycling behavior at different power consumer resistance values is obtained, the OT (on time) which occurs in each case is easily reproducible. Since the work power is not passed by way of the separate heating element of the bimetal, because the work power circuit and the heating power circuit are parallel, even power consumers without relatively low output can be effectively controlled with the power control device.

The secondary claims 2 and 3 result in structural simplifications of the power control device, particularly, it can essentially be produced fully automatically, in available automatic equipment. The heating element rests against the swing end of the bimetal more less loosely, is held in place with a rivet connection in the area of its inner end, and contacted at the same time, and force is exerted on its projecting end by the transfer pin, with initial tension, with this transfer pin ensuring the movement coupling between the bimetallic element-heating element module and the switch with spring contacts. At the same time, the transfer pin also serves to carry power to the heating element, so that additional wiring of circuit measures are completely unnecessary. Because of the initial tension of the transfer pin with regard to the bimetallic element, good contact is guaranteed, where it is important that the heating element rests on a projection of the swing end of the bimetal, more or less like a see-saw, and therefore the transfer pin, which presses the projecting end of the heating element down with initial tension, also ensures good contact at the other end of the heating element, namely in the area of the rivet connection. In addition, since the contact between the heating element carrier and the bimetal is linear, the movement of the bimetal is not negatively influenced.

By means of the characteristics of claim 8, the heating element is securely held in place by the pressure of the fixed transfer pin, which is directed to the projecting end.

The power control device can be equipped with a compensation bimetal, or without one. If a compensation bimetal is considered to be necessary, it is advantageous to form the inner end of the bimetallic element as a Z-shaped compensation bimetal which counteracts the movement direction of the bimetal. This makes it possible to maintain the advantageously simple structure of the power control device.

Figure 2:
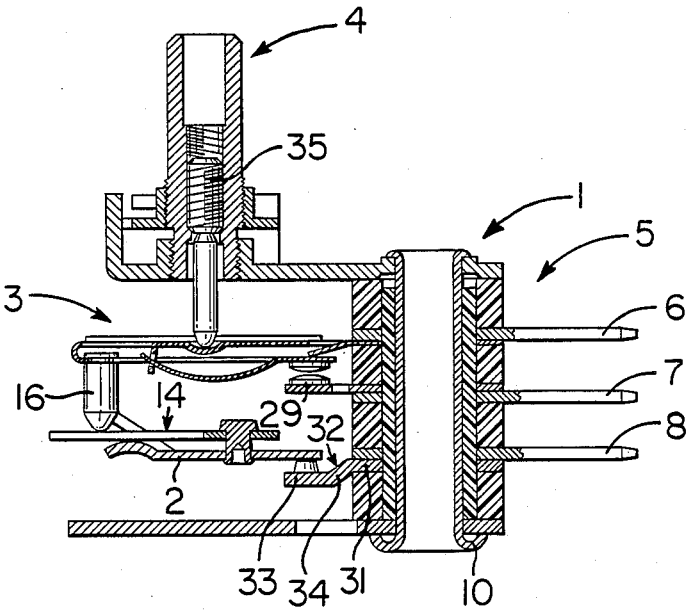
Figure 3:
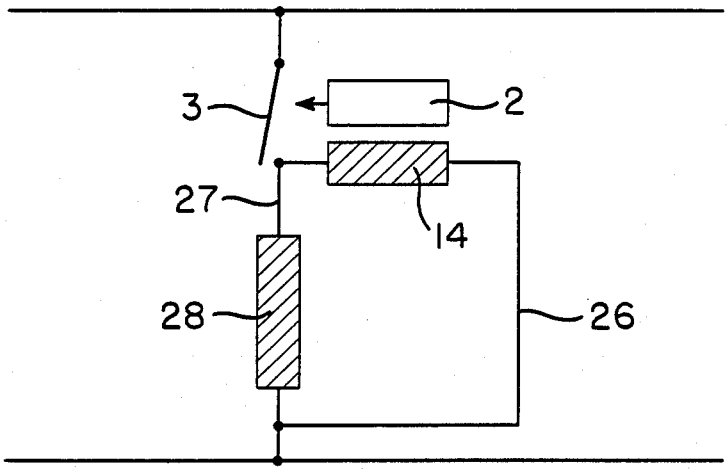

The invention is explained in more detail in the drawing figures, using embodiments. The figures show:

FIG. 1: a cross-section through a power control device without compensation bimetal;

FIG. 2: a cross-section through a power control device with compensation bimetal;

FIG. 3: a schematic wiring diagram of the power control device.

Figure 4:
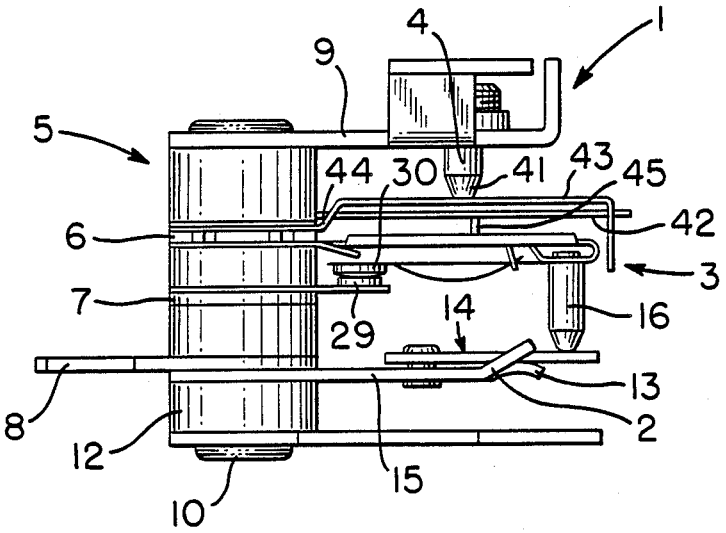

FIG. 4: a side view of the power control device with a modified embodiment of the compensation bimetal.

[The punctuation was not changed in the German to reflect the addition, so it does not necessarily have to be changed in the English, but actually there should now be a ";" at the end of the description of FIG. 3 instead of a "."]

The power control device 1 for devices which can be electrically heated consists of a bimetallic element 2 which can be electrically heated, a switch with spring contacts 3 which can be activated by the swing movement of the bimetallic element 2, a regulator 4 which can be manually activated, to influence the switching point of the switch with spring contacts 3, an extended carrier 5, to which the bimetallic element 2, the switch with contact springs 3, connection or contact elements 6–8, as well as a holder arm 9 are attached.

The carrier 5 has a column-like structure and consists of a hollow rivet 10, which is surrounded by a sleeve of insulating material 11 and disk-like spacers 12, with the latter holding components attached to the carrier 5, each provided with a hole at their attachment ends, between them.

The swing end 13 of the bimetallic element 2 is provided with a separate electrical heating element 14, to which current can be applied independently of the power consumer of the device, via the root 15 of the bimetallic element 2 on the other hand and via a metallically formed transfer pin 16 on the other hand. The transfer pin 16 transfers the swing movement of the swing end 13 of the bimetallic element 2 to one activation end 17 of the switch with spring contacts 3 to which it is riveted. The transfer pin 16 exerts force on the heating element 14 with initial stress direction in the direction of the arrow 18, so that sufficiently good contact between the tip 19 of the transfer pin 16 and an opposing contact surface 20 is ensured.

The heating element 14 is formed as a metal film heating element arranged on a separate carrier element 21, which projects beyond the swing end 13 of the bimetallic element 2, where the transfer pin 16 exerts force on it at its projecting end. At its inner attachment end, the heating element 14 is attached with play by means of a rivet 23, in order to prevent lateral slipping, lateral guide elements 24 are provided, which surround the center area of the heating element 14. Between the guide elements 24, the projection which runs lateral to the direction of longitudinal extension of the bimetallic element, in the form of a bead 25, is provided; this supports the heating element 14 like a see-saw.

As is particularly evident in FIG. 3, the heating element 14 is arranged in a parallel power circuit 26 to the work power circuit 27, which in turn contains the power consumer 28 which heats the electrical device. The heating power circuit 26 runs through a fixed contact 29 arranged on the carrier 5, separately connected with a connection element 7, the movable contact 30 of the switch with spring contacts 3, the transfer pin 16, the heating element 14 and the bimetal root 15, while the work power circuit 27 runs through the fixed contact 29, the movable contact 30 of the switch with spring contacts 3 and the related frame elements, to the connection element 6.

The opposing contact surface 20 of the heating element 14 could be formed by a rivet head. Which passes through the heating element 14 and the heating element carrier 21 made of ceramic material.

In the embodiment shown in FIG. 2, the inner end of the bimetallic element 2 is formed by a compensation bimetal 32 which responds to ambient temperature and counteracts the movement direction of the bimetallic element 2, and which is bent away from the switch with spring contacts 3 in the shape of a Z, and the bimetallic element 2 is arranged on the leg 33 of the Z directed away from the carrier 5, on the side facing the switch with spring contacts 3, with the length of the center leg of the Z approximately corresponding to the material thickness of the bimetallic element 2, in order to extensively be able to maintain the structurally pre-determined distance and dimensions in the area of the switch with contact springs 3, the transfer pin 16, the heating element 14 and the bimetallic element 2.

The regulator, which is attached to the holder arm 9, is formed as a spindle drive 35 which moves forward axially towards the switch with spring contacts when turned manually, but it is also possible to use regulators which function in a different way (cranks or similar units).

The embodiment of a power control device 1 shown in FIG. 4 is modified with regard to the one shown in FIGS. 1 and 2 insofar as a compensation bimetal strip 42 is arranged between the end 41 of the setting spindle (regulator 4) facing the switch with spring contacts 3 and the switch with spring contacts 3 and acts there. The compensation bimetal strip 42 runs parallel to the switch with spring contacts 3, its length approximately corresponds to the length which the switch with spring contacts 3 projects away from the carrier 5.

The compensation bimetal strip 42 is arranged on a bimetal holder 43, which is attached to the carrier 5 at its one end 44, and can be moved back or forth together with the bimetal 42 which is attached there by force exerted by the end 41 of the regulator 4.

The holder element 43 has a stirrup-like or almost U shape, the compensation bimetal strip 42 is fixed in the two U ends of the stirrup-shaped holder element 43 in the manner of a bendable beam which is clamped at both end sides, and activates the switch with spring contacts 3 with its center area. In the center area of the compensation bimetal strip 42, an activation projection 45 is arranged, which exerts force on the switch with spring contacts 3.

The method of action of the compensation device shown in FIG. 4 is as follows:

If no temperature deviation to be compensated occurs, the compensation bimetal strip 42 retains its relative position to the holder element 43 and is moved up or down together with the holder element 43 when the regulator 4 is turned; the switching point of the switch with spring contacts 3 can be influenced in this way.

If the temperature value to be compensated changes, the relative position between the stirrup-shaped holder element and the center area of the bimetal strip also changes, the activation projection 45 changes the switching point of the switch with spring contacts—without any adjustment of the spindle—thereby bringing about the compensation action.

I claim:

1. A power control device for controlling the power supplied to electrically heated devices, particularly cooking devices, such as stove burners, ovens, grills, microwave ovens and similar items, with (a) a bimetallic element which can be electrically heated and having a root and a swing end,
(b) a switch with spring contacts which can be activated by a swing movement of the bimetallic element and having an activation end,
(c) a regulator which can be activated manually, to influence the switching point of the switch with spring contacts,
(d) a holder arm for supporting the regulator,
(e) contact elements,
(f) an extended carrier, to which the bimetallic element, the switch with spring contacts, contact elements and holder arm are attached, essentially at a right angle of projection,
(g) a transfer pin arranged essentially parallel to the carrier, between the swing end of the bimetallic element and the activation end of the switch with spring contacts, with initial tension,
(h) spacers of insulating material on the carrier separating the the bimetallic element, the switch with spring contacts, contact elements and holder arm attached thereto, characterized in that the swing end of the bimetallic element is provided with a carrier element and an electrical heating element, to which power can be applied independently of the supply of power to the power consumer of the device through a circuit parallel to the power consumer circuit of the device, such parallel circuit including the root of the bimetallic element, said electrical heating element and the transfer pin, said electrical heating element being structured as a metal film resistor arranged on said carrier element, the transfer pin applying initial tension to the electrical heating element.

2. A power control device according to claim 1, further characterized in that the heating element projects beyond the swing end of the bimetallic element and that the transfer pin exerts force on such projecting end of the heating element for applying the initial tension.

3. A power control device according to claim 2, further characterized in that the heating element is attached at one end with play to a side of the bimetallic element which faces the switch with spring contacts.

4. A power control device according to claim 1 or 2, further characterized in that the swing end of the bimetallic element is provided with lateral guide elements for the heating element.

5. A power control device according to claim 1, further characterized in that the projection on the bimetallic element is formed by a bead which runs lateral to the direction of longitudinal extension of the bimetallic element, in a direction toward the heating element.

6. A power control device according to claim 1, further characterized in that said carrier supports three connection elements for connecting the device to electricity and a fixed contact connected to one of said connection elements, the device being further characterized in that the parallel circuit includes said fixed contact, a movable contact of the spring contacts, the transfer pin, the heating element, the bimetallic root and a second of said connection elements, and in that the power consumer circuit includes the first connection element, the fixed contact, the movable contact of the spring contacts, the holder elements of the switch with spring elements and the third connection element.

7. A power control device according to claims 1 or 2, further characterized in that the transfer pin is attached at one end thereof to the activation end of the switch with spring contacts in the manner of a rivet, such that it cannot move relative to the switch with spring contacts, and in that the transfer pin, at the other end thereof facing the heating element, has a tip exerting force on a contact surface of the heating element.

8. A power control device according to claims 1 or 2, further characterized in that the heating element carrier is comprised of ceramic material having a first flat side facingly on the bimetallic element and a second flat side facing away from the bimetallic element, the heating element being formed on the second flat side as a metal film resistor.

9. A power control device according to claim 1 or 2, further characterized in that the transfer pin engages a contact surface of the heating element and in that the distance between the contact surface and the swing end of the bimetallic element is approximately 3 mm.

10. A power control device according to claims 1 or 2, further characterized in that the heating element carrier has a bore which surrounds a rivet with play, a beaded end of the rivet exerting force on a contact surface of the heating element which surrounds the bore.

11. A power control device according to claims 1 or 2, further characterized in that the root of the bimetallic element is formed as a compensation bimetal which responds to ambient temperature and counteracts the movement direction of the bimetallic element.

12. A power control device according to claim 10, further characterized in that the compensation bimetal is bent away from the switch with spring contacts in the shape of a Z, and the bimetallic element is arranged on a leg of the Z leading away from the heating element carrier on the side thereof facing the switch with spring contacts, with the length of the center leg of the Z approximately corresponding to the material thickness of the bimetallic element.

13. A power control device according to claims 1 or 2, further characterized by the fact that a compensation bimetal strip is disposed between an end of a setting spindle of the regulator facing the switch with spring contacts and the switch with spring contacts.

14. A power control device according to claim 13, further characterized in that the compensation bimetal strip extends in parallel with the switch with spring contacts.

15. A power control device according to claim 14, further characterized in that the length of the compensation bimetal strip approximately corresponds to the length of the switch with spring contacts.

16. A power control device according to claim 13, further characterized in that the compensation bimetal strip is disposed on a bimetal holder which is movable together with the bimetal by force exerted by the setting spindle of the regulator.

17. A power control device according to claim 13, further characterized in that the compensation bimetal strip is fixed in a stirrup-shaped holder element in the manner of a bendable beam clamped at both ends, and activates the switch with spring contacts.

18. A power control device according to claim 17, further characterized in that in the center area of the compensation bimetal strip, approximately aligned with the regulator, an activation projection is arranged on the compensation bimetal strip, which exerts force on the switch with spring contacts.

* * * * *